US005988835A

United States Patent [19]

Allen

[11] Patent Number: 5,988,835

[45] Date of Patent: Nov. 23, 1999

[54] ROTATING MULTIPLE GEL AND PATTERN MOUNT FOR FILM/VIDEO LIGHTS

[76] Inventor: John C. Allen, 27 Irving Ter., #3, Cambridge, Mass. 02138

[21] Appl. No.: 08/995,193

[22] Filed: Dec. 22, 1997

[51] Int. Cl.[6] ..... F21V 17/02

[52] U.S. Cl. ..... 362/324; 362/323; 362/284

[58] Field of Search ..... 362/319, 322, 362/323, 324, 277, 279, 282, 284

[56] References Cited

U.S. PATENT DOCUMENTS

| | | | |
|---|---|---|---|
| 1,613,562 | 1/1927 | Frost | 362/324 |
| 2,943,185 | 6/1960 | DeMott | 362/324 X |
| 3,045,208 | 7/1962 | Tiberio | 362/284 |
| 3,080,474 | 3/1963 | Allen | 240/10.1 |
| 4,891,738 | 1/1990 | Richardson et al. | 362/282 |
| 4,893,225 | 1/1990 | Solomon | 362/293 |
| 5,113,332 | 5/1992 | Richardson | 362/282 |
| 5,138,530 | 8/1992 | Lowell | 362/323 X |
| 5,416,681 | 5/1995 | Wu | 362/284 |
| 5,513,083 | 4/1996 | Chang | 362/284 |
| 5,608,580 | 3/1997 | Quadri | 362/324 X |

*Primary Examiner*—Laura K. Tso

*Attorney, Agent, or Firm*—Duft, Graziano & Forest, PC; Curtis A. Vock

[57] ABSTRACT

The invention modifies light illuminating from a video/film production light system of the type that includes a lamp and fixturing to form a light beam about a substantially fixed direction relative to the fixturing. A mounting frame attaches to the fixturing in a substantially rigid manner, and a rod connects to the frame. A disc having a plurality of light modifying sections is constructed and arranged to rotate about the rod and within the beam such that the beam passes through any one of the sections selectively. Each section has an optical element that modifies the beam and, thereby, the light. The invention also provides a production light, including a lamp for projecting light onto a background scene, a reflector for collecting and directing the light toward the scene, light fixturing for housing the lamp and reflector, a dial for housing a plurality of sections, each section having a light modifying element, and an axle mounted with the fixturing. The dial is rotatable about the axle and relative to the fixturing for positioning one section in front of the lamp such that the light passes through the light modifying element of the section. The dial can be adjusted axially along the rod to modify, for example, pattern shapes as viewed on the scene.

12 Claims, 8 Drawing Sheets

ROTATING MULTIPLE GEL AND PATTERN MOUNT FOR FILM/VIDEO LIGHTS

BACKGROUND OF THE INVENTION

A variety of lights and light fixturing occupy a typical stage, photographic session, and video set. The basic lights in such settings have very distinctive purposes:

(1) the "key" light functions to illuminate the subject person;

(2) the "fill" light functions to soften shadows created by the key light;

(3) the "background" light functions to color or to create patterns on the background without illuminating the subject person; and (4) the "back" light functions to illuminate the back of the subject person's hair and shoulders to distinguish the person from the background.

Accessories for such lights include "gels, "diffusions," and "patterns". Gels are thin plastic semi-rigid films that are placed in front of the back lighting source to create artistic effects or to modify the color temperature of the light source. By way of example, a blue gel might be used over a video light to compensate for blue spectra emitted from fluorescent lamps.

A diffusion, which might be constructed like a gel, is used in front of a light source to soften light intensity and to diffuse background shadows. One exemplary diffusion is a tissue-like material that is placed over the desired lamp to scatter and diffuse light in many directions. "Patterns" are sometimes classified as diffusions and generally include designer patterns which permit projection of a selected pattern onto the background to project scenery and/or to create atmosphere. By way of example, an exemplary pattern is an etched pattern of tree leaves which can be projected and/or diffused onto the background.

A photographer typically carries an array of diffusions, gels and patterns for a given setting. Diffusions, gels and patterns are commonly mounted to the light source with clothes pins directly coupled to the light fixture of the source. To create a different lighting effect, the photographer mounts a new gel, diffusion or pattern with the light to create the desired effect.

It is generally a time-consuming task to mount gels, diffusions and patterns within a given photographic, video or stage setting. New gels, diffusions and/or patterns must be mounted relative to the light so that the source light aligns through the element and toward the desired lighting point. Patterns, in addition, must be spaced from the source at a selected distance, much like "focussing", to create the desired artistic effect on the target (e.g., the background). The combination of mounting, aligning and focussing diffusions, gels and patterns relative to desired lighting creates certain operational difficulties which slow the production process.

It is, accordingly, an object of the invention to provide flexible lighting apparatus which increases the ease of replacing gels, diffusions and patterns within a photographic, stage and video setting.

Another object of the invention is to provide apparatus which provides for both alignment and focussing of gels, diffusions and patterns relative to a lighting source.

Still another object of the invention is to provide apparatus and methods for semi-automated selection, alignment and/or focus of one or more gels, diffusions and/or patterns from an array of gels, diffusions and/or patterns.

These and other objects will become apparent in the description which follows.

SUMMARY OF THE INVENTION

The invention is particularly suited for operation as, or with, a background light. However, in certain aspects, the invention provides a light source and fixturing that are suitable for use as, or replacement to, any of the prior art lights discussed above. In another aspect, the invention provides adaptive fixturing and associated mechanics to mount to existing prior art lights so as to augment such lights with the features of the invention, including flexibility in selecting and utilizing gels, diffusions and/or patterns.

As used herein, "dial" and "disc" are used interchangeably to denote a multi-aperture disc that provides for mounting of a plurality of gels, diffusions and/or patterns.

The invention provides, in one aspect, a light dial which brings flexibility, control and creativity to stage, photographic and/or video lights. The light dial includes a disc and a mounting frame. The mounting frame is designed to couple to existing light fixturing. By way of example, the Omni light by Lowell® is one common back light used in video productions. The Omni light includes a lamp and light fixturing to support the lamp. In accord with the invention, the mounting frame in this example is sized so as to permit mounting onto the Omni light fixturing.

The dial is divided into sections, typically disc quadrants, within which gels, diffusions and/or patterns are mounted. In this aspect, the dial mounts onto the mounting frame such that the associated lamp projects light through one of the sections to create the desired effect. A user merely rotates the dial relative to the frame to change the gel, diffusion and/or pattern.

In another aspect, the apparatus of the invention includes a rod that couples to the mounting frame. Specifically, the dial mounts onto the rod such that, again, the lamp projects light through one of the sections to create the desired effect. To change the size of a displayed pattern, i.e., to adjust focus, the user moves the disc along the rod to adjust the distance between the dial and the lamp. Preferably, in another aspect, the rod slides onto the mounting frame through a hole in the frame. Focussing in this aspect can thus be accomplished by axially adjusting the rod through the hole, or by axially adjusting the dial on the rod, or both.

In still another aspect, a dial is mounted with an array of gels to provide the user with an array of colors, or grades of the same color, by rotating the dial. In another aspect, a dial is mounted with an array of diffusions such that each section provides a different diffusion (or a different grade of a diffusion material). The user in this aspect can thus select and easily implement a desired diffusion by rotating the dial to the correct section. In still another aspect, a dial is mounted with an array of patterns such that each section has a unique pattern. Accordingly, a user can mount a gel dial and easily select one of an array of gels. By mounting a pattern dial, the user can select one of an array of patterns. A diffusion dial, similarly, provides the user with an array of diffusions. The user simply replaces one dial for another when switching between gels, diffusion, and patterns, for example.

In another aspect of the invention, the dial is mounted with one or more gels, one or more diffusions, and/or one or more patterns to give increased flexibility within a single dial.

In still another aspect, the invention provides a light suitable for stage, photographic and/or video lighting. By way of example, the light can be a fill light, a key light, a background light, or a back light. In one aspect, the light includes a source lamp, fixturing to house and support the lamp, and a dial (such as described above) that mounts to the fixturing. The dial rotates at a point on the fixturing such that one section of the disc (with a gel, diffusion of pattern therein) is placed in front of the beam generated by the lamp, creating the desired effect. Alternatively, the fixturing can include a rod attachment (such as a mounting hole) so that a rod such as discussed above can be coupled to the fixturing. The disc is thereafter mounted to a rod for rotation and focussing purposes.

In another aspect, the invention provides apparatus for modifying light illuminating from a video/film or photographic production light system of the type that includes a lamp and fixturing to form a light beam along a substantially fixed direction relative to the fixturing. The apparatus includes a mounting frame for attachment to the fixturing in a substantially rigid manner, a rod connected to the frame, and a disc having a plurality of light modifying sections. In this aspect, the disc is constructed and arranged to rotate about the rod and within the beam such that the beam passes through any one of the sections selectively. Each section has an optical element therein, if desired, that modifies the beam and, thereby, the light emitted by the lamp.

In one aspect, the optical element is a gel; and in another aspect, the optical element is a diffusion. In still another aspect, the element is a pattern.

In another aspect, the optical element is a diffracting aperture; while in another aspect, the optical element is a shadow pattern. The diffracting aperture generally creates a diffraction pattern on the background; and the shadow pattern generally creates a similar pattern on the background. By way of example, one diffraction aperture is a slit; and the diffraction pattern is represented by the Fraunhofer pattern created on the background and generally perpendicular to the slit (the diffracting pattern becoming more pronounced with sources that emit in a smaller waveband, such as quasi-monochromatic sources). Similarly, one exemplary pattern is a star shape that appears as a star shape on the background, the size and clarity of which is adjusted by moving the disc axially along the rod (i.e., focussing).

In one aspect, the disc includes a slot for mounting the disc onto the rod. The slot extends radially from a center of the disc such that a user can slide the disc onto the rod for rotation about the disc center. Preferably, a spring-loaded latch is connected with the disc in this aspect such that a user can selectively engage and disengage the rod at the center.

In another aspect, the disc includes one or more clips to hold at least one optical element in a substantially fixed position relative to at least one section. Preferably, the disc has four sections arranged as ninety degree pie quadrants.

In a preferred aspect of the invention, means are included for engaging and selectively disengaging the disc along the rod, wherein a user can move the element parallel to the beam to change focused characteristics of the background light.

Useful background for the invention may be found with reference to the following patents, each of which is incorporated herein by reference: U.S. Pat. No. 5,113,332; U.S. Pat. No. 4,891,738; U.S. Pat. No. 3,080,474; U.S. Pat. No. 4,893,225; U.S. Pat. No. 5,416,681; and U.S. Pat. No. 5,513,083.

The invention is next described further in connection with preferred embodiments, and it will become apparent that various additions, subtractions, and modifications can be made by those skilled in the art without departing from the scope of the invention.

BRIEF DESCRIPTION OF THE DRAWINGS

A more complete understanding of the invention may be obtained by reference to the drawings, in which.

DETAILED DESCRIPTION OF THE DRAWINGS

Figure 1:
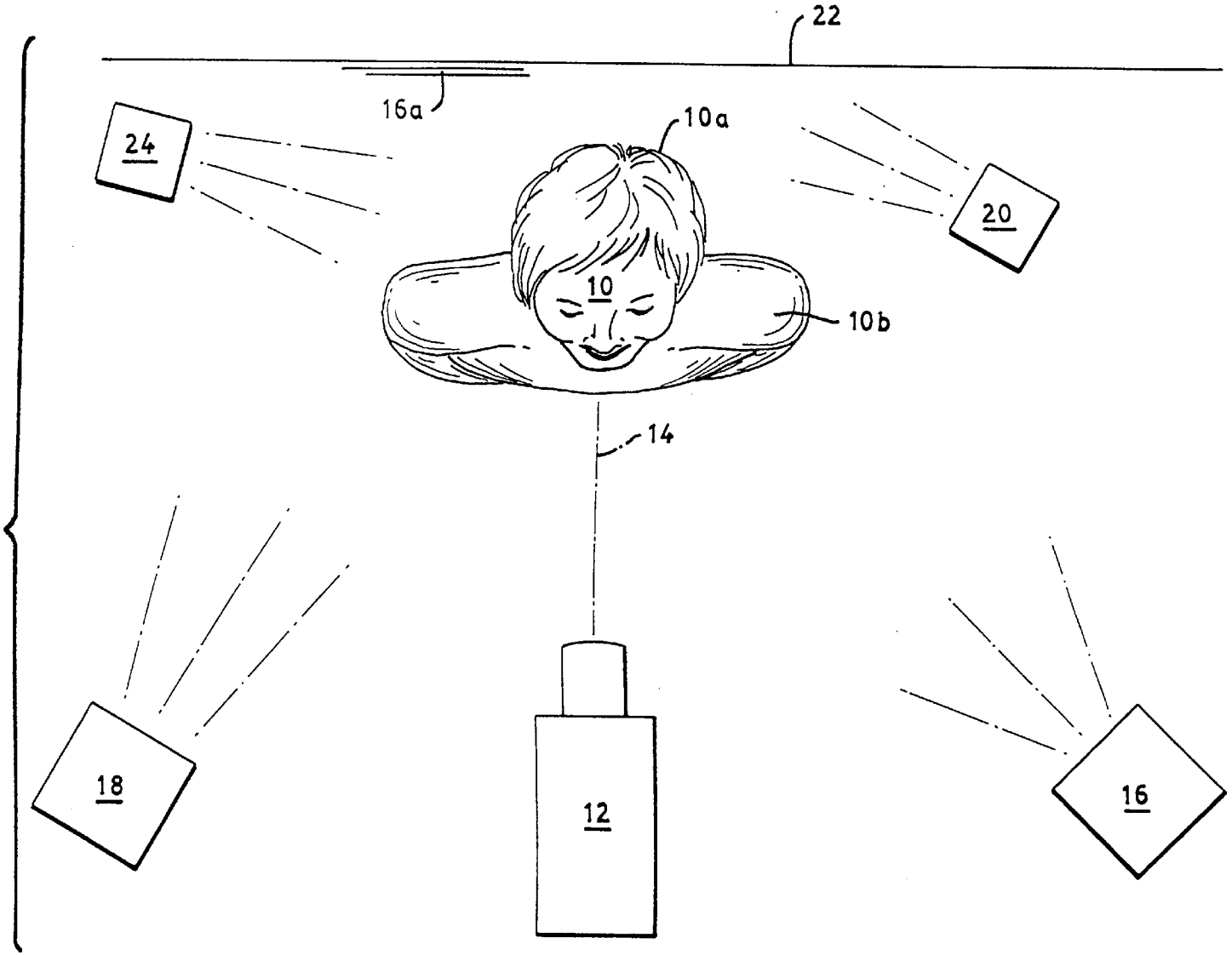
FIG. 1 illustrates typical lighting sources and positions for a video production.

FIG. 1 illustrates various lighting sources for a typical video production of a subject person 10. A camera 12 is positioned to view the person along a film-capture axis 14. The key light 16 is positioned adjacent to the camera 12 to illuminate the subject person 10; while the fill light 18 softens the shadows 16*a* (and/or other shadows on the subject person 10) created by the key light 16. The background light 20 is positioned to illuminate a bland, e.g., white, background 22 so as to project artistic patterns or colors onto the background 22. The back light 24 is positioned to highlight the subject person's hair 10*a* and shoulders 10*b* so as to distinguish the subject person 10 from the background 22 as viewed through the camera 12.

The invention described herein is most suitable for application with the background light 20 of FIG. 1. However, the invention is readily used with or as the other lights 16, 18 and 24.

Figure 2:
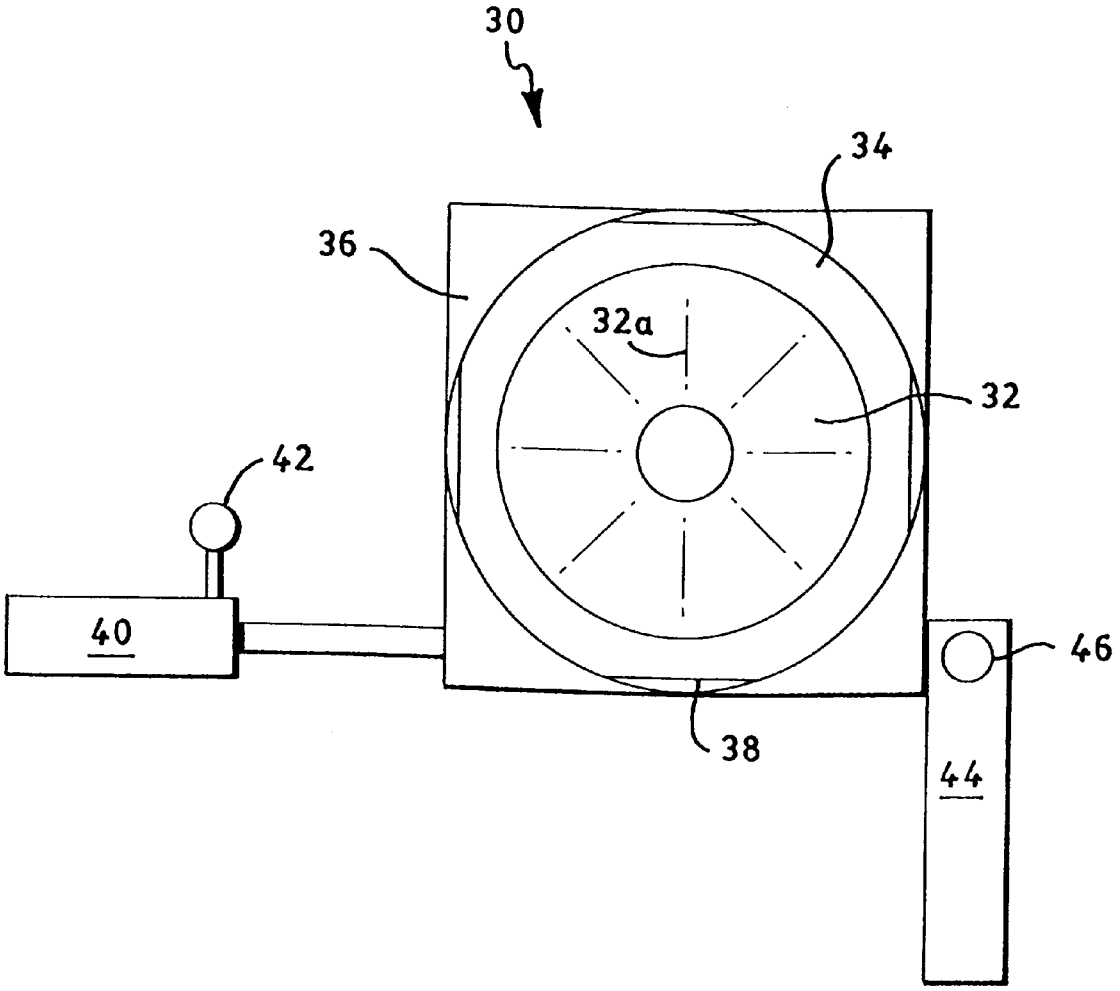
FIG. 2 (PRIOR ART)
FIG. 2 shows a front view of a prior art light suitable for use in stage, photographic and video sessions.

FIG. 2 shows an exemplary prior art light 30, including: a lamp 32 to emit light 32*a*, a reflector 34 to help project the light 32*a* in a particular direction, light fixturing 36 to house the lamp 32, and housing notches 38 for barn door attachments, as known in the art. Typically, the light 30 is attached to a pivoting handle 40 connected to the fixturing 36 so that a user can control the back light 30. A flood/spot adjust knob 42 controls light divergence emitted from the lamp 32 The back light 30 typically mounts to a light stand 44 such that the back light can be pivoted about a pivot point 46.

Figure 3:
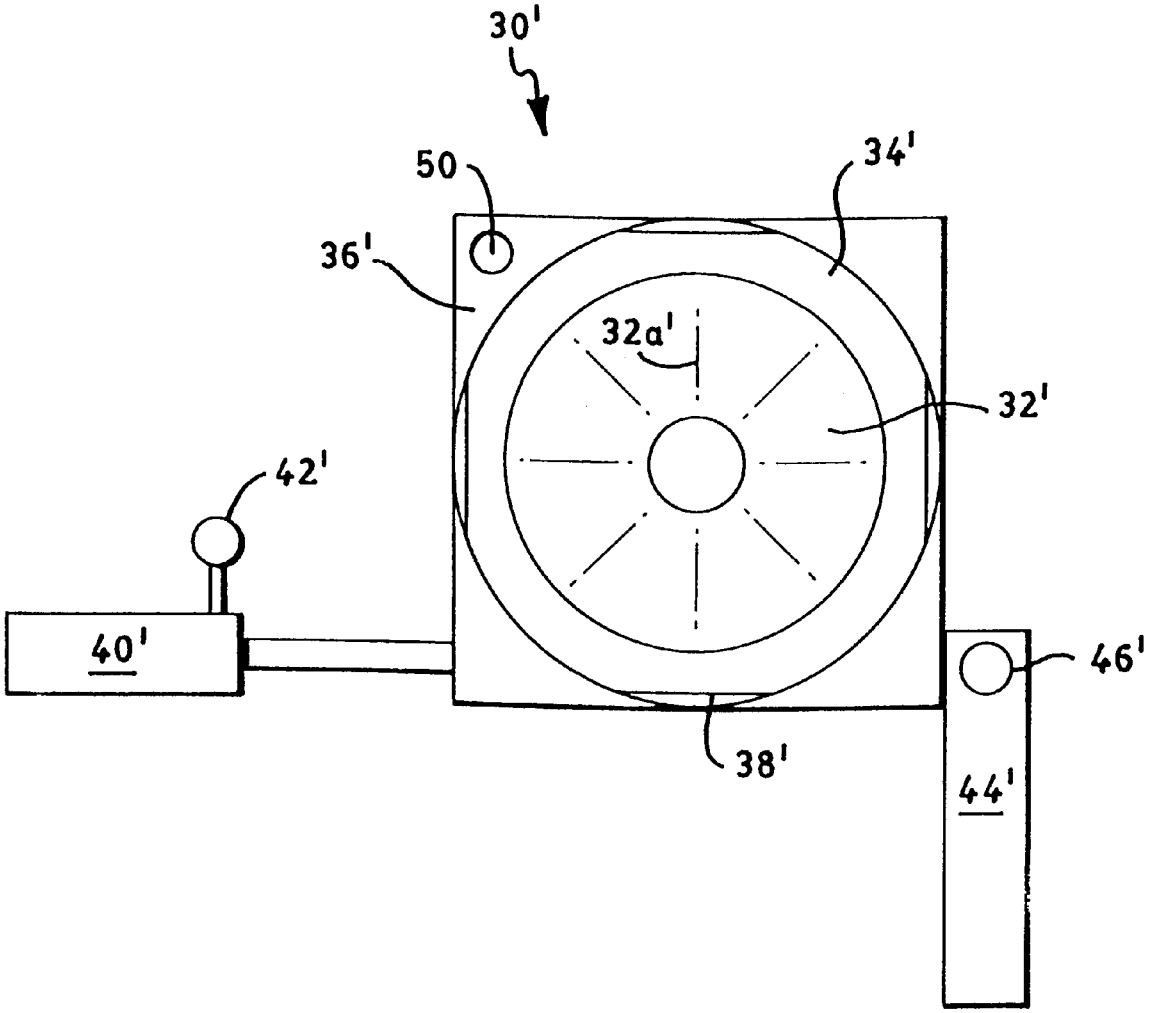
FIG. 3 shows a front view of a light constructed according to the invention and suitable for replacing the light of FIG. 2.

In one embodiment of the invention, the fixturing 36 of FIG. 2 is modified so as to provide a rotation point 50, such as shown in FIG. 3. The rotation point 50 represents either a hole within the fixture 36', so that a rod (as described herein) can extend therethrough; or a small post or axel. In either case, a disc mounts onto the rod or axle so as to rotate selective light modifying sections (gels, diffusions and/or patterns) in front of the lamp 32'.

Figure 4:
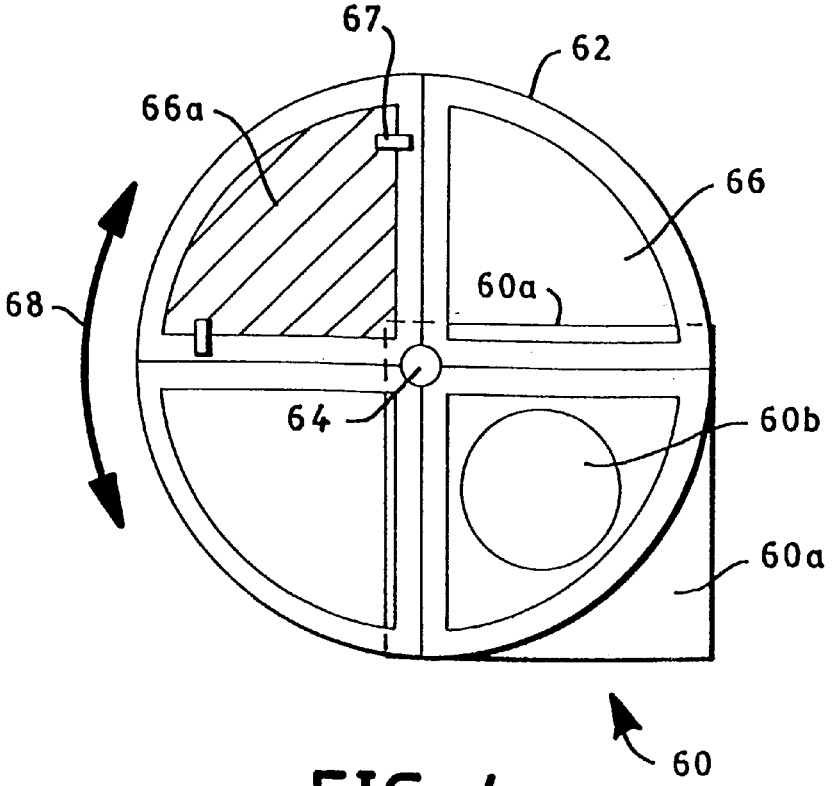
FIG. 4 shows an operational front view of a light with a rotating disc mounted therewith, in accord with the invention.

FIG. 4 shows a front view of a light 60 constructed according to the invention. The light 60 includes a disc 62 that is mounted with light fixturing 60*a* to rotate about a rotation point 64. The disc 62 is shown in one preferred embodiment with four ninety degree pie aperture sections 66. Within each aperture section 66, a gel, diffusion or pattern 66*a* is secured to the disc 62 via clip elements 67 so that the lamp 60*b* (FIG. 4A) projects through one of the sections 66, thereby modifying the light characteristics emitted by the lamp 60*b* according to the selected gel, diffusion or pattern. In operation, therefore, a user rotates the disc 62 in a direction 68 to change the gel, diffusion or pattern, selectively.

Figure 4A:
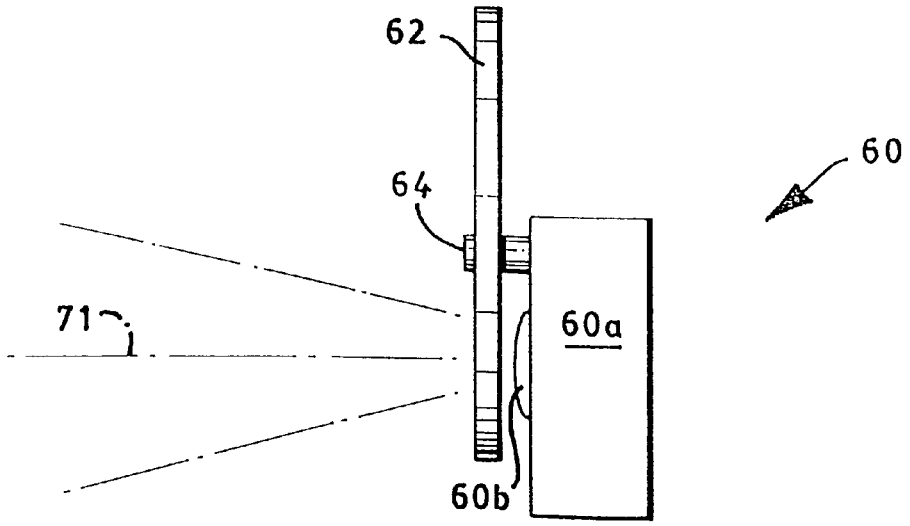
FIG. 4A shows a side view of the light and disc of FIG. 4.

FIG. 4A shows a side view of the light 60 of FIG. 4. As illustrated, the disc 62 mounts to an axle or post 64 for rotation thereon. Light 71 emitted from the lamp 60*b* is modified by the gel, diffusion or pattern within the section 66 that is aligned in front of the lamp 60*b*.

Figure 5:
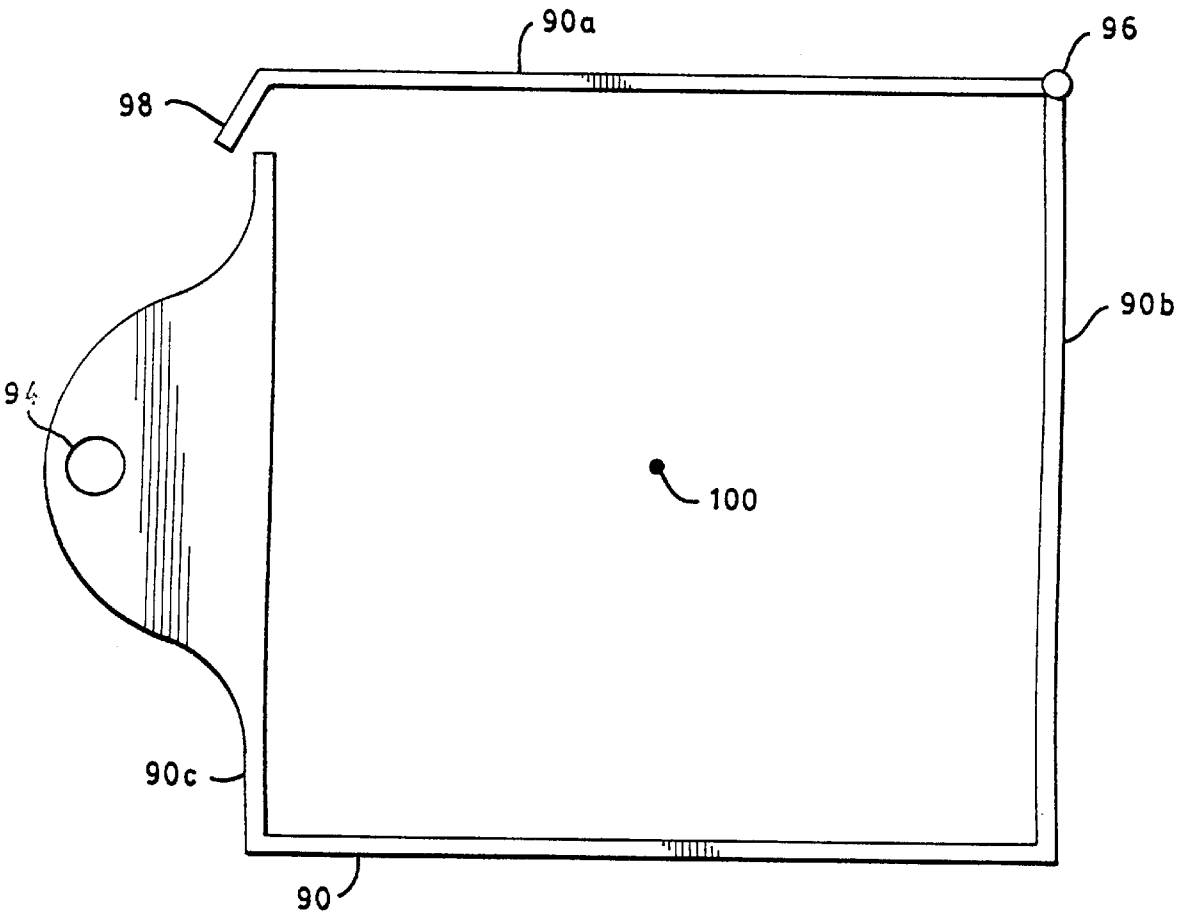
FIG. 5 shows a front view of a mounting frame constructed according to the invention.
Figure 5A:
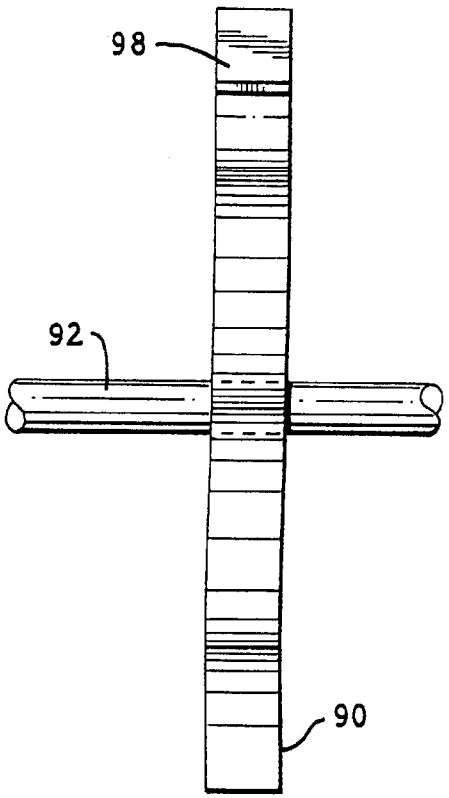
FIG. 5A shows a side view of the frame of FIG. 5.

For after-market applications, the invention includes a mounting frame which mounts, for example, onto the fixturing 36 of FIG. 2. FIG. 5 illustrates, in a front view, one such mounting frame 90. FIG. 5A shows a side view of the frame 90; and additionally shows a rod 92 extending through the frame 90. As shown, the frame 90 includes a hole 94 that provides passage for the rod 92 (FIG. 5A). To attach the frame 90 to light fixturing, the frame 90 is opened at one side 90*a*. Specifically, a hinge 96 connects the side 90*a* to a side 90*b* of the frame 90; and a latch 98 connects the side 90*a* to, and alternatively releases the side 90*a* from, one side 90*c* of the frame 90.

In operation, the frame 90 mounts over the existing light fixturing, e.g., the fixturing 36 of FIG. 2, and the latch 98 securely locks the frame 90 in place and onto the fixturing. The hole 94 is spaced from the center 100 of the frame 90 (which is also, generally, the location of the lamp, e.g., the lamp 32 of FIG. 2) so that the disc (e.g., the disc 62 of FIG. 4) rotates about the rod 92 and a disc section substantially covers the lamp to modify light emitted from the lamp according to the gel, diffusion or pattern within the section.

Figure 6:
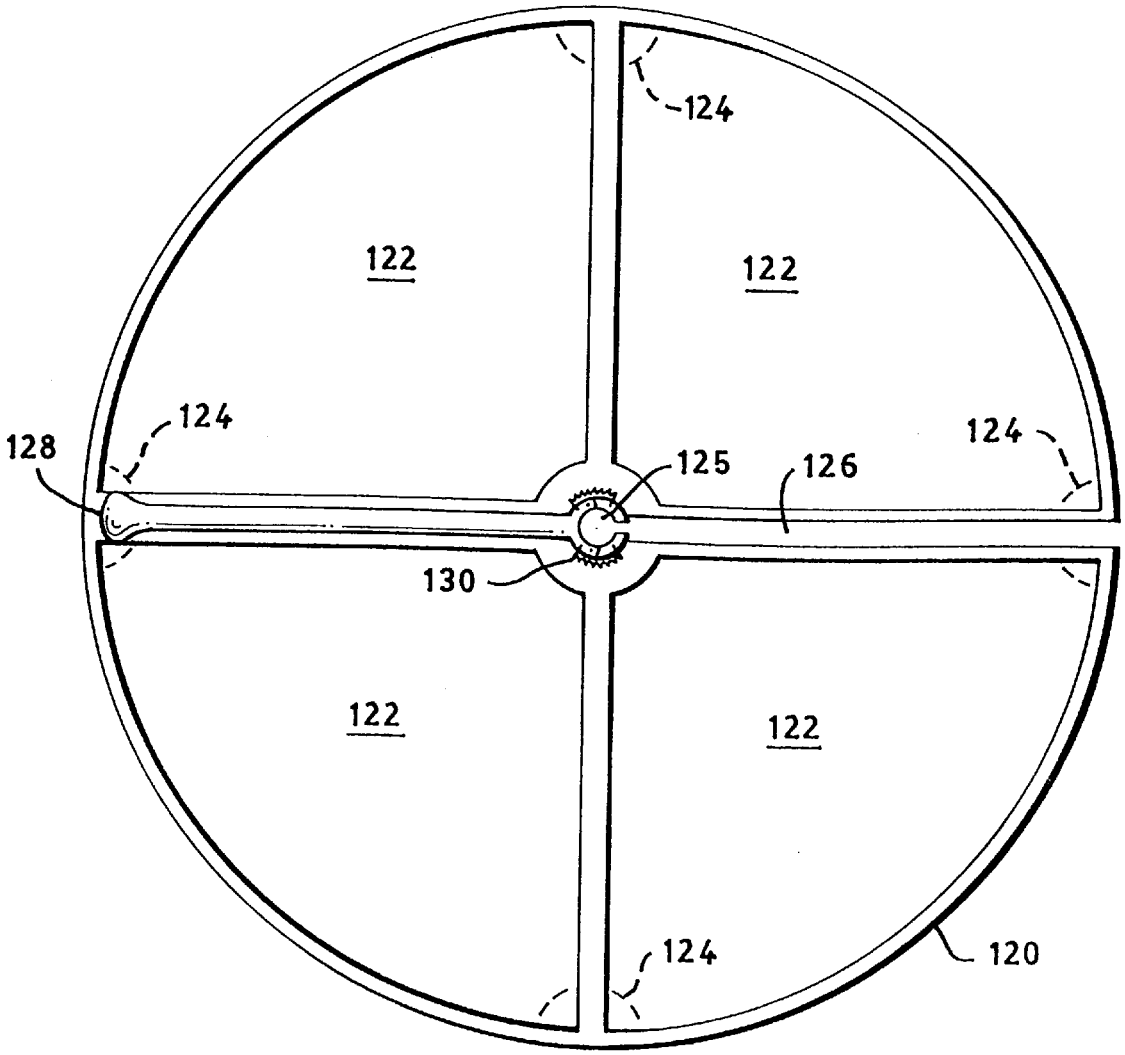
FIG. 6 shows a front view of a light dial constructed according to the invention.

FIG. 6 illustrates one light dial 120 constructed according to the invention. The dial 120 has four sections 122 for placement of selected gels, diffusions and/or patterns, which are held onto the dial 120 by clips 124. The dial 120 mounts to a frame (e.g., the frame 90 of FIG. 5) or to back light fixturing (e.g., the fixturing 36' of FIG. 3) so as to rotate one of the sections 122 in front of the beam generated by the back light. The dial 120 rotates about a rotation point 125, which is generally occupied by a rod, such as the rod 92 of FIG. 5A, or by a post, such as the post 64 of FIG. 4A mounted directly to the fixturing 60*a*.

Placement of the dial 120 over the rod is facilitated by a mounting slot 126. The slot 126 removes the necessity of aligning the mounting hole 125 directly on the end of the rod. Rather, with the slot 126, a user can simply slide the dial 120 onto the rod. A finger-operated latching mechanism 128 (known to those skilled in the art) releases and alternatively closes a spring latch 130 about the rotation point 125, thereby releasing and alternatively securing the dial 120 relative to the rod.

Figure 7:
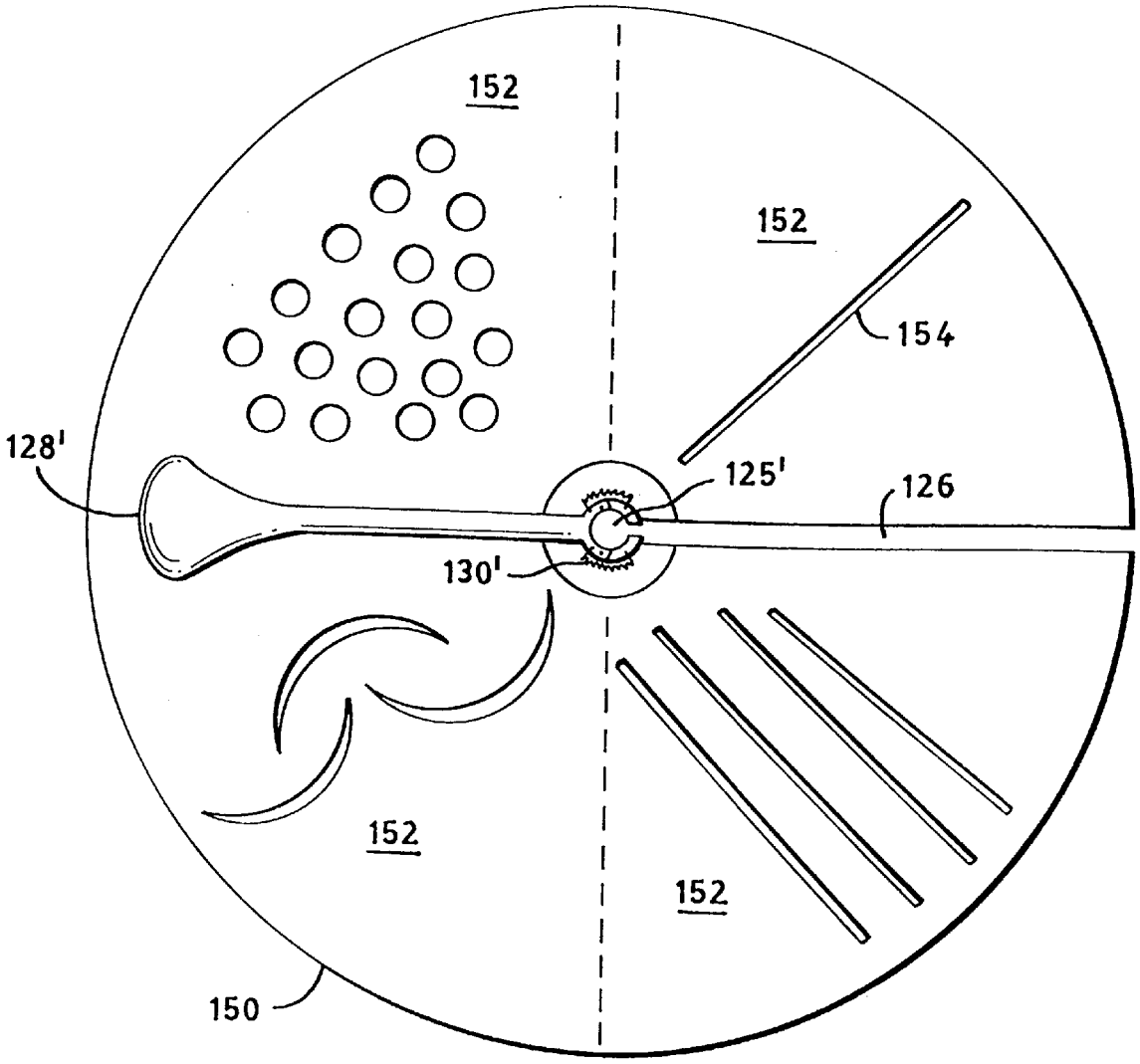
FIG. 7 shows an alternative disc constructed according to the invention.

FIG. 7 illustrates another dial 150 constructed according to the invention. The dial 150 operates like the dial 120 of FIG. 6; except that different patterns 154 occupy any given section 152 of the dial 150.

Those skilled in the art should appreciate that the four sections 122 of FIG. 6, and the four sections 152 of FIG. 7, are shown for illustrative purposes only; and that more or fewer sections 122 can be implemented within a single dial as desired.

Figure 8:
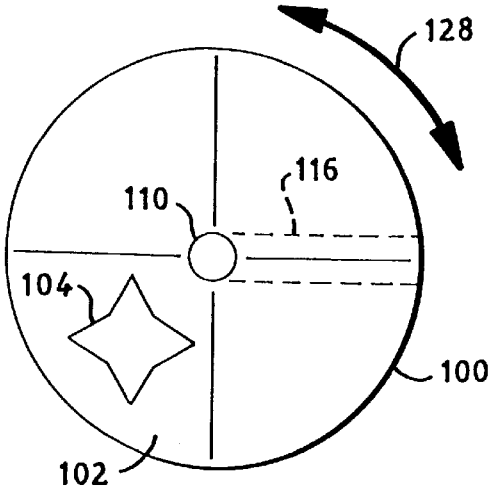
FIGS. 8 and 8A illustrate one lighting system of the invention to focus patterns selectively.
Figure 8A:
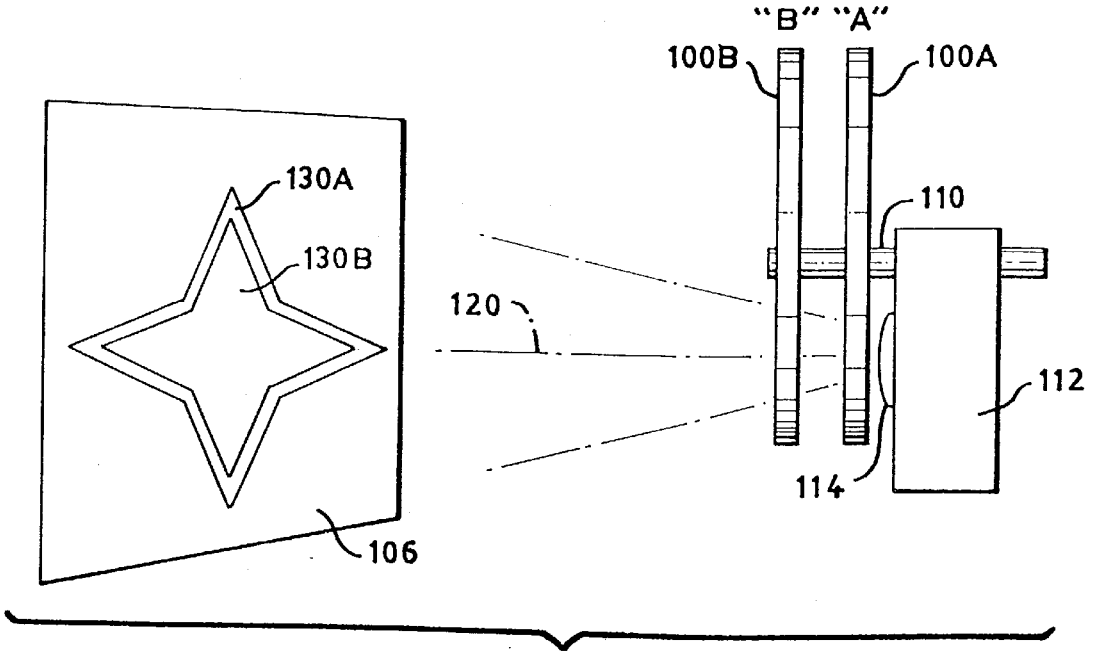

FIGS. 8 and 8A illustrate pattern focussing, in according to the invention. Specifically, FIG. 8 shows a front view of a light dial 100 constructed according to the invention. An exemplary pattern 104 is mounted within one quadrant 102 of the dial 100 for projection onto a scene 106 (FIG. 8A). The "scene" 106 is shown for illustrative purposes; and can for example represent a background wall or a target object, e.g., a subject person.

FIG. 8A shows a side view of the dial 100; and additionally illustrates the dial 100 mounted onto a rod 110. The rod 110 is mounted through light fixturing 112 which supports and houses the lamp 114. The lamp 114 emits light 120 that illuminates the scene 106. The pattern 104 is rotated (e.g., in a direction 128) to the appropriate position by the user such that light 120 passes through the pattern 104 to create a corresponding shadow pattern 130 on the scene 106.

FIG. 8A illustrates two positions "A" and "B" of the dial 100 on the rod 110. A user selects such positions by axially displacing the dial 100 along the rod. For this purpose, the rod 110 is fairly long; and thus the mounting of the dial 100 is facilitated by the mounting slot 116, such as discussed above, whereby a user can simply slide the dial 100 onto the rod 110 at any location on the rod 110. The dial 100 is closer to the lamp 114 at position "A" as compared to "B". As such, shadow pattern 130A formed by the light 120 when passing through the pattern 104 at position "A" is larger than the shadow pattern 130B created by light 120 passing through the pattern 104 at position "B". In accord with the invention, a user thus slides the dial 100 to the position which creates the desired size and effect on the scene 106.

The invention thus attains the objects set forth above, among those apparent from preceding description. Since certain changes may be made in the above apparatus and methods without departing from the scope of the invention, it is intended that all matter contained in the above description or shown in the accompanying drawing be interpreted as illustrative and not in a limiting sense.

It is also to be understood that the following claims are to cover all generic and specific features of the invention described herein, and all statements of the scope of the invention which, as a matter of language, might be said to fall there between.

Having described the invention, what is claimed as new and secured by letters patent is:

1. Apparatus for modifying light illuminating from a video/film system, the light system of the type that includes a lamp and fixturing to form a light beam about a substantially fixed direction relative to the fixturing, comprising:

a mounting frame for attaching to the fixturing in a substantially rigid manner;

a rod connected to the frame; and a disc having a plurality of light modifying sections, the disc being constructed and arranged to rotate about the rod and within the beam such that the beam passes through any one of the sections selectively, each section having an optical element that modifies the beam and, thereby, the light, the disc having a slot for mounting the disc onto the rod, the slot extending radially from a center of the disc wherein a user can slide the disc onto the rod such that the disc rotates about the center.

2. Apparatus according to claim 1, wherein the optical element comprises a gel.

3. Apparatus according to claim 1, wherein the optical element comprises a diffusion.

4. Apparatus according to claim 1, wherein the optical element comprises a diffracting aperture.

5. Apparatus according to claim 1, wherein the optical element comprises a pattern.

6. Apparatus according to claim 1, further comprising a spring-loaded latch connected with the disc, the latch being constructed and arranged with the disc such that a user can selectively engage and disengage the rod at the center.

7. Apparatus according to claim 1, wherein the disc further comprises one or more clips to hold the optical element in a substantially fixed position on the disc.

8. Apparatus according to claim 1, wherein the disc has four sections arranged as ninety degree quadrants.

9. Apparatus according to claim 1, further comprising means for engaging and selectively disengaging the disc along the rod, wherein a user can move the element substantially parallel to the rod to change focused characteristics of the background light.

10. Flexible lighting apparatus, comprising a lamp for projecting light onto a scene, a reflector for collecting and directing the light toward the scene, light fixturing for housing the lamp and reflector, a dial for housing a plurality of sections, each section having a light modifying element, and an axle mounted with the fixturing, the dial having slot means for mounting the dial onto the axle, the dial being rotatable about the axle and relative to the fixturing for positioning one section in front of the lamp such that the light passes through the light modifying element of the section.

11. Flexible lighting apparatus according to claim 10, further comprising means for positioning the dial along the axle so as to adjust the spacing between the dial and the lamp.

12. A method of modifying production lighting, comprising the steps of: mounting a rod to production light, the production light of the type having a lamp therein to project a light beam onto a scene, mounting a disc to the rod through a slot in the disc, the disc having a plurality of apertures therein, each aperture being sized to substantially accommodate the beam, mounting at least one of a gel, diffusion and pattern within one or more apertures, and rotating the disc about the rod to align a selected aperture to the beam, thereby modifying the light beam according to the characteristics of the gel, diffusion and pattern within the aperture.

* * * * *